US008585471B2

(12) United States Patent
Shabla

(10) Patent No.: US 8,585,471 B2
(45) Date of Patent: Nov. 19, 2013

(54) SANDING BLOCK

(76) Inventor: Steven Paul Shabla, Lake Havasu City, AZ (US)

( * ) Notice: Subject to any disclaimer, the term of this patent is extended or adjusted under 35 U.S.C. 154(b) by 280 days.

(21) Appl. No.: 12/974,406

(22) Filed: Dec. 21, 2010

(65) Prior Publication Data

US 2011/0177767 A1 Jul. 21, 2011

Related U.S. Application Data

(60) Provisional application No. 61/297,046, filed on Jan. 21, 2010.

(51) Int. Cl.
*B24D 15/00* (2006.01)

(52) U.S. Cl.
USPC ..... 451/498; 451/497; 451/523

(58) Field of Classification Search
USPC ..... 451/496, 497, 523
See application file for complete search history.

(56) References Cited

U.S. PATENT DOCUMENTS

| | | | | | |
|---|---|---|---|---|---|
| 1,562,414 | A | * | 11/1925 | Lester | 451/502 |
| 2,103,320 | A | * | 12/1937 | Corff | 451/503 |
| 2,457,045 | A | * | 12/1948 | Kitterman | 451/502 |
| 2,595,429 | A | * | 5/1952 | Trussell | 451/523 |
| 2,804,729 | A | * | 9/1957 | Dahlstrom | 451/503 |
| 4,501,096 | A | * | 2/1985 | Lukianoff | 451/502 |
| 4,536,994 | A | * | 8/1985 | Krebs | 451/59 |
| 4,744,180 | A | * | 5/1988 | Voorhees | 451/490 |
| 4,837,985 | A | * | 6/1989 | Mayama | 451/496 |
| 5,168,663 | A | * | 12/1992 | Klocke | 451/523 |
| 5,177,909 | A | * | 1/1993 | Klocke | 451/490 |
| 5,522,763 | A | * | 6/1996 | Regnier | 451/502 |

* cited by examiner

*Primary Examiner* — Maurina Rachuba

(57) ABSTRACT

A sanding block comprises a support block having a right side and a left side. A gripping slot extends from the right side to the left side. The gripping slot is capable of receiving ends of a sheet of sandpaper folded around the support block.

1 Claim, 2 Drawing Sheets

SANDING BLOCK

RELATED APPLICATION INFORMATION

This Application is a Non-Provisional of U.S. Provisional Application Ser. No. 61/297,046, filed Jan. 21, 2010.

BACKGROUND OF THE INVENTION

The present invention generally relates a sanding block. More specifically, the invention relates to a multi-surface sanding block with a self-locking mechanism for sandpaper.

Existing sanding blocks typically use only one sanding surface. Further, adhesive or some other locking system is required to hold the sandpaper to the sanding bock, making manufacturing more expensive and requiring more setup time for use.

As can be seen, there is a need for a multi-surface sanding block that is less expensive to manufacture and use.

SUMMARY OF THE INVENTION

In one aspect of the present invention, a sanding block comprises a support block having a right side and a left side. A gripping slot may extend from the right side to the left side. The gripping slot may be capable of receiving ends of a sheet of sandpaper folded around the support block.

In another aspect of the present invention, a sanding block comprises a tubular support block having a right side and a left side. A gripping slot may extend from the right side to the left side. The gripping slot may be capable of receiving ends of a sheet of sandpaper folded around the support block.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a sanding block with a self-locking mechanism for sandpaper.

Figure 1:
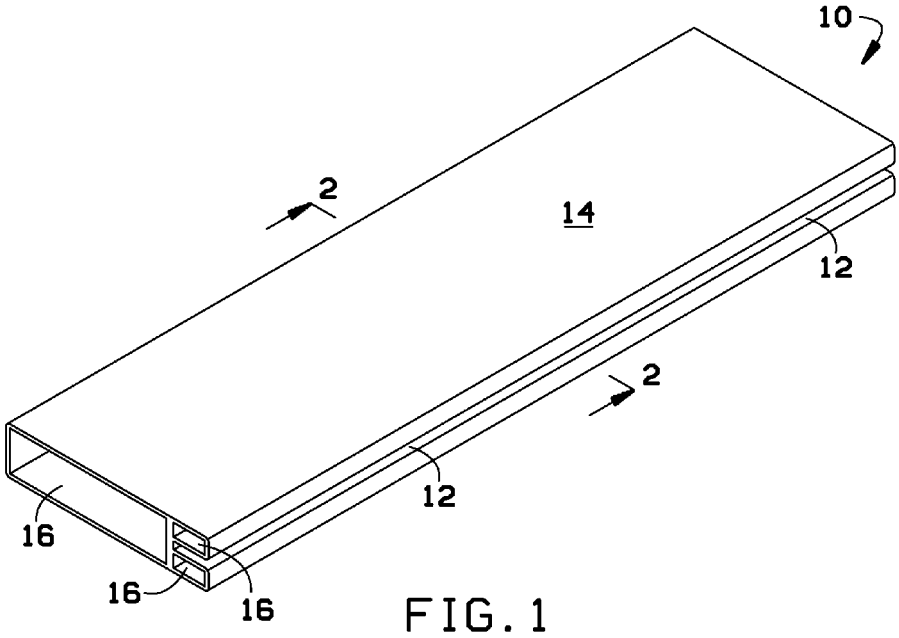
FIG. 1 is a perspective view of a sanding block according to one embodiment of the present invention.

With reference to FIG. 1, a perspective view of a sanding block 10 is shown according to one embodiment. The sanding block may include a support block or tube 14, the support block or tube having a hollow main body having a top surface, a bottom surface, two side surfaces and two end surfaces, and a longitudinal axis. An elongated gripping slot 12 may be formed along the entire front side, the slot formed between two, spaced apart, hollow secondary bodies, the secondary bodies having longitudinal axes that are parallel to the longitudinal axis of the main body, the edges of the slot having rounded edges. The gripping slot 12 may extend from the right side to the left side.

Figure 2:
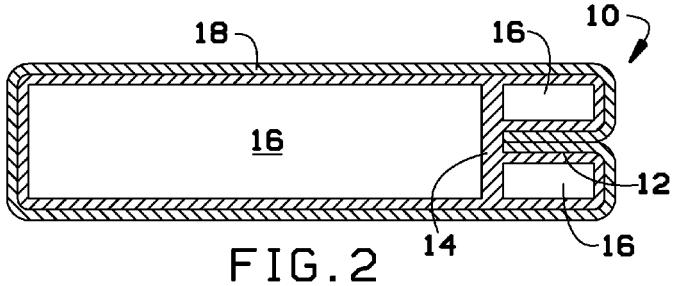
FIG. 2 is a sectional view of the sanding block taken along line 2-2 in FIG. 1.

With reference FIG. 2, a section view of the sanding block 10 taken along line 2-2 in FIG. 1 is shown. In FIG. 2, a sheet of sandpaper 18 may be folded in the manner shown around the support block 14. Ends of the sandpaper 18 may be inserted into the gripping slot 12. In one embodiment, the ends of the sandpaper 18 may fit snugly into the gripping slot 12 to thereby secure the sandpaper to the support block 14 during use.

Figure 3:
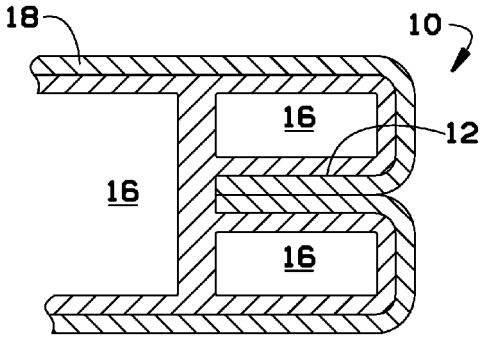
FIG. 3 is a detail view of the sectional view of FIG. 2.

With reference to FIG. 3, a detail of the sectional view of FIG. 2 is shown. In FIG. 3, the manner in which the sandpaper 18 may be folded and fit into the gripping slot 12 can be seen in more detail.

Figure 4:
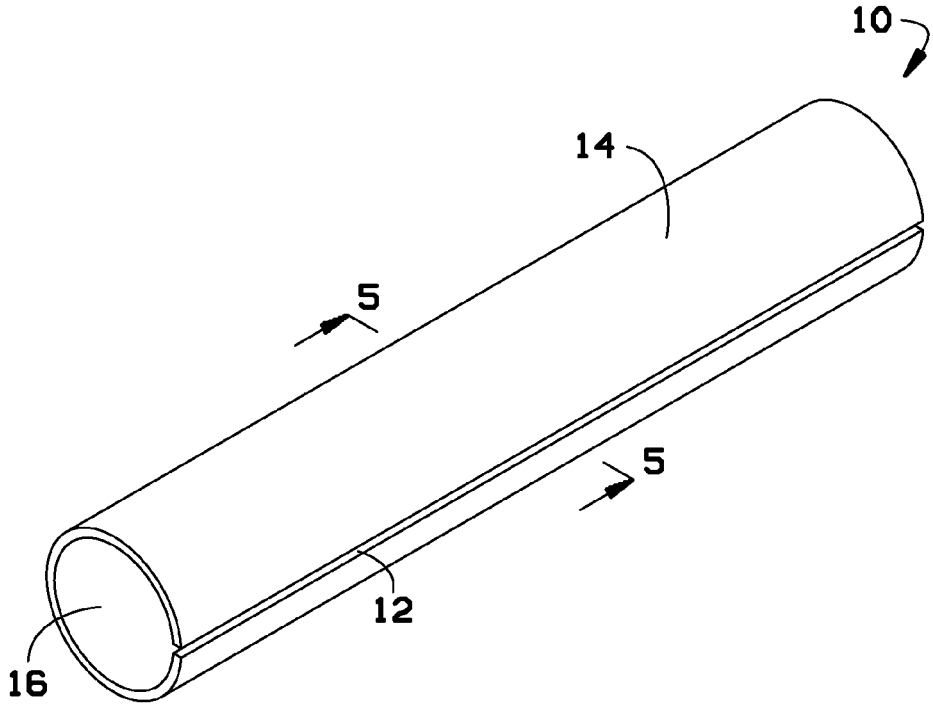
FIG. 4 is a perspective view of a sanding block according to an alternate embodiment of the present invention.

With reference to FIG. 4, a perspective view of the sanding block 10 is shown according to an alternative embodiment. In the embodiment of FIG. 4, the support block 14 may be tubular, instead of square shaped, and formed around one hollowed or open area 16 extending through the support block 14, which may have a left side and a right side. The gripping slot 12 may comprise a slot or break cut in the tube, extending from the left side to the right side as shown.

Figure 5:
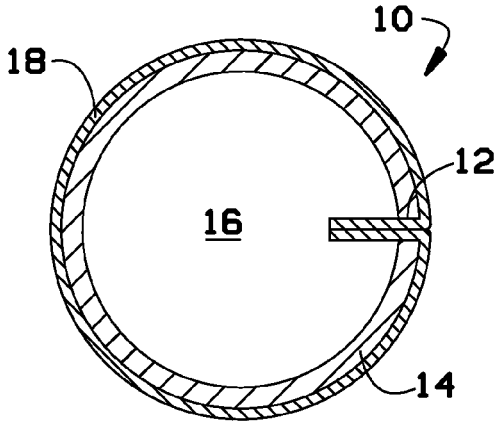
FIG. 5 is a sectional view of the sanding block taken along line 5-5 in FIG. 4.

With reference to FIG. 5, a sectional view of the sanding block taken along line 5-5 in FIG. 4 is shown. In FIG. 4, the sandpaper 18 may be positioned around the support block 14 in the manner shown. Ends of the sandpaper 18 may be inserted into the gripping slot 12. In one embodiment, the ends of the sandpaper 18 may fit snugly into the gripping slot 12 to thereby secure the sandpaper to the support block 14 during use.

It should be understood, of course, that the foregoing relates to exemplary embodiments of the invention and that modifications may be made without departing from the spirit and scope of the invention as set forth in the following claims.

I claim:

1. A sanding block, comprising

A. a rectangular, hollow, main body, the main body comprising a top surface, a bottom surface, two side surfaces, and two end surfaces, and a longitudinal axis;

B. two smaller, hollow, secondary bodies, the secondary bodies positioned on the main body on a side surface and each secondary body having a length that is substantially equal to the length of the side surface of the main body; the secondary bodies having longitudinal axes that are substantially parallel to the longitudinal axis of the main body; the secondary bodies spaced apart on the side surface to form a gap or slot, the gap or slot having longitudinal edges that are substantially parallel to the longitudinal axis of the main body, wherein the gap or slot is adapted to securely hold between the secondary bodies the edges of a sandpaper sheet wrapped around the main body;

C. the longitudinal edges of the gap or slot are beveled or chamfered, wherein the sandpaper sheet is not scored or cut during use.

* * * * *